United States Patent [19]

Hinami

[11] Patent Number: 4,942,389

[45] Date of Patent: Jul. 17, 1990

[54] DISPLAY CONTROL CIRCUIT

[75] Inventor: Junji Hinami, Tokyo, Japan

[73] Assignee: NEC Corporation, Tokyo, Japan

[21] Appl. No.: 196,230

[22] Filed: May 20, 1988

[30] Foreign Application Priority Data

May 22, 1987 [JP] Japan ..... 62-124017

[51] Int. Cl.[5] ..... G09G 1/00

[52] U.S. Cl. ..... 340/703; 340/799

[58] Field of Search ..... 340/703, 702, 701, 798, 340/799

[56] References Cited

U.S. PATENT DOCUMENTS 4,672,368 6/1987 Williams ..... 340/703

4,772,881 9/1988 Hannah ..... 340/701

OTHER PUBLICATIONS

Artwick, "Microcomputer Displays, Graphics, and Animation", Prentice-Hall, New Jersey, 1985, pp. 64–66.

*Primary Examiner*—Alvin Oberley

*Attorney, Agent, or Firm*—Burns, Doane, Swecker and Mathis

[57] ABSTRACT

A display control circuit includes a video memory for storing display data assigned with a plurality of bits corresponding to each pixel of a display screen of a display device, and at least one color designation circuit. Each color designation circuit includes a rewritable color value register, a selector for selecting outputs from the color value register in accordance with color signal information of the display data read out from the video memory, an element number register for storing preset element numbers, an element number coincidence detector for comparing element number information of the display data read out from the video memory with the preset element numbers, and an output buffer, controlled in accordance with an output from the element number coincidence detector, for supplying a signal to a driver for the display device.

4 Claims, 4 Drawing Sheets

DISPLAY CONTROL CIRCUIT

BACKGROUND OF THE INVENTION

The present invention relates to a display control circuit and, more particularly, to a display control circuit for changing plural types of colors or densities at high speed.

In a conventional display device, a rewritable color value register is used in a color designation circuit and the color designation circuit is arranged as an IC (Integrated Circuit), as is known to those skilled in the art.

An example of a conventional display device shown in FIG. 1 will be described below.

Referring to FIG. 1, a video memory 3 stores display data assigned with a plurality of bits corresponding to each pixel of a display screen of the display device. Display data supplied from a processor 1 is written in the video memory 3 under the control of a write controller 2. The contents of the video memory 3 are read out under the control of a read controller 4 and are output to a color designation circuit 12. The color designation circuit 12 is an IC comprising a rewritable color value register 5 and a selector 6 for selecting outputs from the color value register 5 in accordance with color signal information of the display data read out from the video memory 3 by the processor 1. G, R and B color signals from the selector 6 are output to G, R, and B drivers 10*a*, 10*b*, and 10*c* for a CRT 11, respectively.

The storage contents of the color value register in the color designation circuit 12 are updated in accordance with the display data from the processor 1, and therefore the display color on the display screen of the CRT 11 can be immediately changed without updating the contents of the video memory 3.

FIG. 2 is a block diagram showing an example of a display device including a plurality of color designation circuits so as to increase the number of colors to be simultaneously displayed.

The same reference numerals as in FIG. 1 denote the same parts in FIG. 2, and a detailed description thereof will be omitted. A video memory 3*a* has the same function as that of the video memory 3, and an extended video memory 3*b* stores element number signals of display data. Each of the video memories 3*a* and 3*b* constitutes a memory for storing display data assigned with a plurality of bits corresponding to each pixel of a display screen of the display device. Each of color designation circuits (ICs) 12*a* to 12*d* has the same function as that of the color designation circuit 12. Outputs from the color designation circuits 12*a* to 12*d* are selected by an element number signal read out from the extended video memory 3*b*, and the selected outputs are supplied to color drivers 10*a*, 10*b*, and 10*c*.

In the conventional display device described above, in order to increase the number of colors to be simultaneously displayed, the number of color value registers in the color designation circuits must be increased. However, since the color designation circuits are ICs, the number of registers in the color designation ICs is fixed. Therefore, the number of color designation ICs must be increased.

When a plurality of color designation ICs are used, a selector 13 (FIG. 2) is required to select the outputs from the color designation circuits (ICs) 12*a* to 12*d*. When the number of color designation ICs is increased, the circuit arrangement of the selector 13 is inevitably complicated. More particularly, in an arrangement wherein n color designation ICs each capable of simultaneously displaying any m of 2 l colors are used to simultaneously display m $\times$n colors of the 2 l colors, l selectors 13 each arranged to select one of the n inputs must be arranged.

The selectors 13 cannot be distributed in the color designation ICs due to contention of outputs from the ICs. When the selectors 13 are arranged as one IC, the number of color designation ICs is determined by the number of inputs of the selector IC, and the extension of the circuit cannot be easily performed.

SUMMARY OF THE INVENTION

It is an object of the present invention to eliminate the conventional drawbacks and to provide a versatile display control circuit, wherein the number of colors to be simultaneously displayed can be increased by a small number of components in a simple circuit arrangement.

According to the present invention, a display control circuit comprises: a video memory for storing display data assigned with a plurality of bits corresponding to each pixel of a display screen of a display device; rewritable color value register means rewritable by a processor; selector means for selecting outputs from the color value register means in accordance with color signal information of the display data read out from the video memory; means for storing preset element numbers; element number coincidence detector means for comparing element number information of the display data read out from the video memory with the preset element numbers; and output buffer means, controlled in accordance with an output from the element number coincidence detector means, for supplying a signal to a driver for the display device.

DETAILED DESCRIPTION OF THE PREFERRED EMBODIMENT

Figure 3:
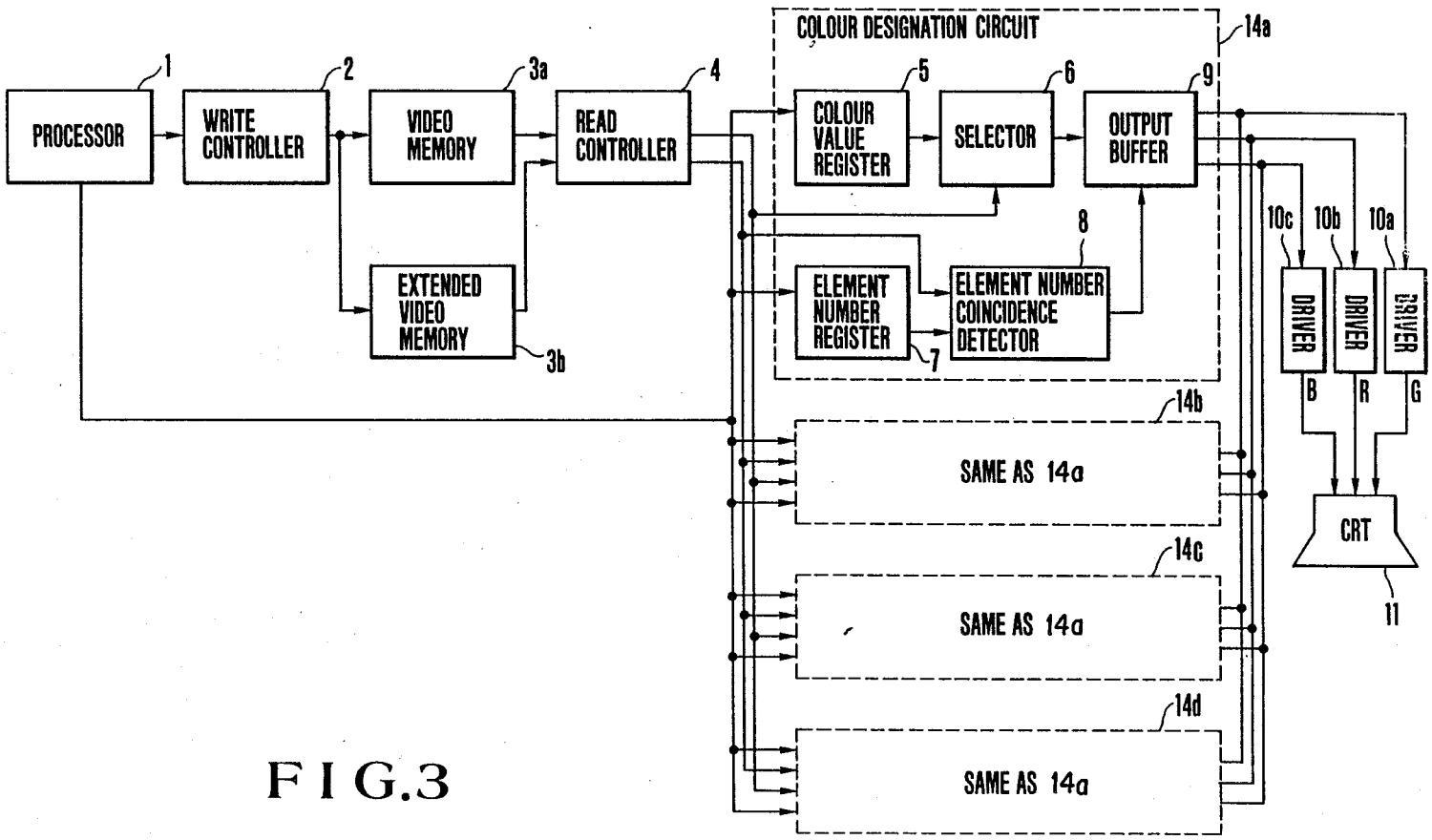
FIG. 3 is a block diagram of a display control circuit according to an embodiment of the present invention.

FIG. 3 is a block diagram showing a display control circuit according to an embodiment of the present invention.

Figure 1:
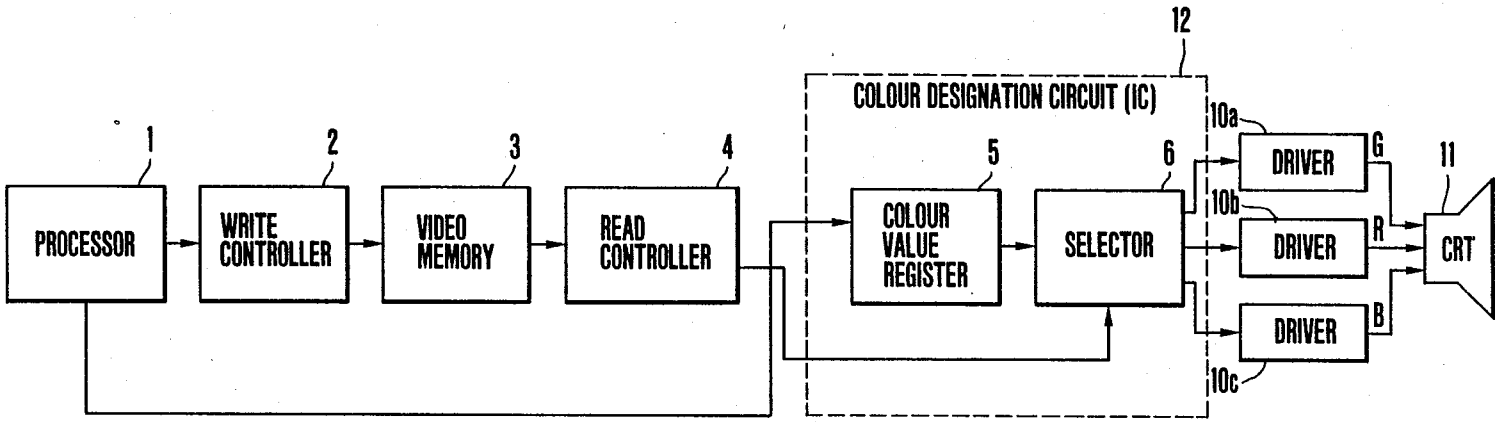
FIG. 1 (PRIOR ART)
FIG. 1 is a block diagram showing a conventional display control circuit.
Figure 2:
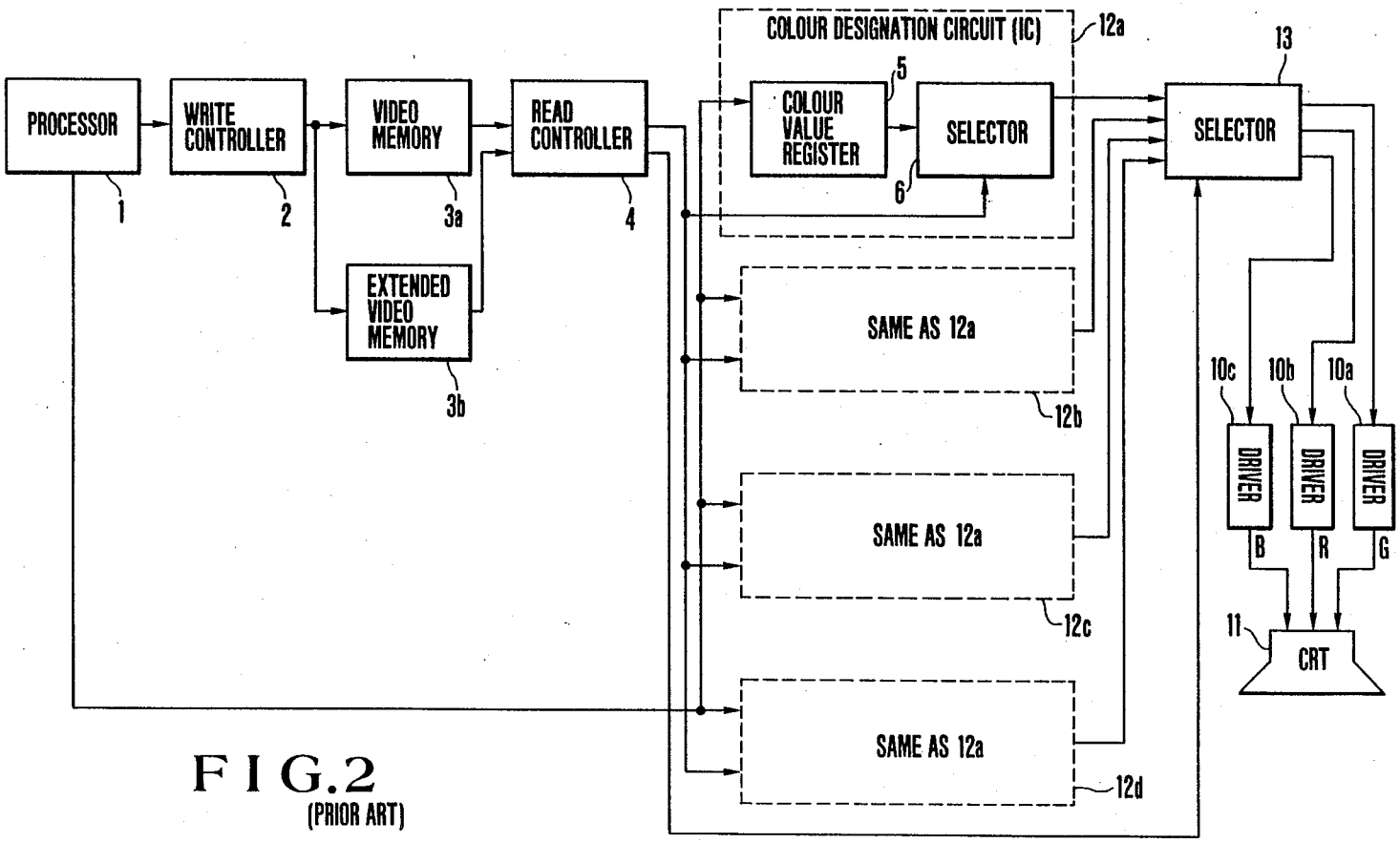
FIG.2 (PRIOR ART)
FIG. 2 is a block diagram showing another conventional display control circuit.

The same reference numerals as in FIGS. 1 and 2 denote the same parts in FIG. 3.

In addition to a color value register 5 and a selector 6, each of color designation circuits 14*a* to 14*d* includes an element number register 7, an element number coincidence detector 8 for comparing a preset element number with element number information of element data read out from an extended video memory 3*b*, and an output buffer 9, controlled in accordance with an output from the element number coincidence detector 8, for supplying a signal to drivers 10*a*, 10*b*, and 10*c*.

Figure 4:
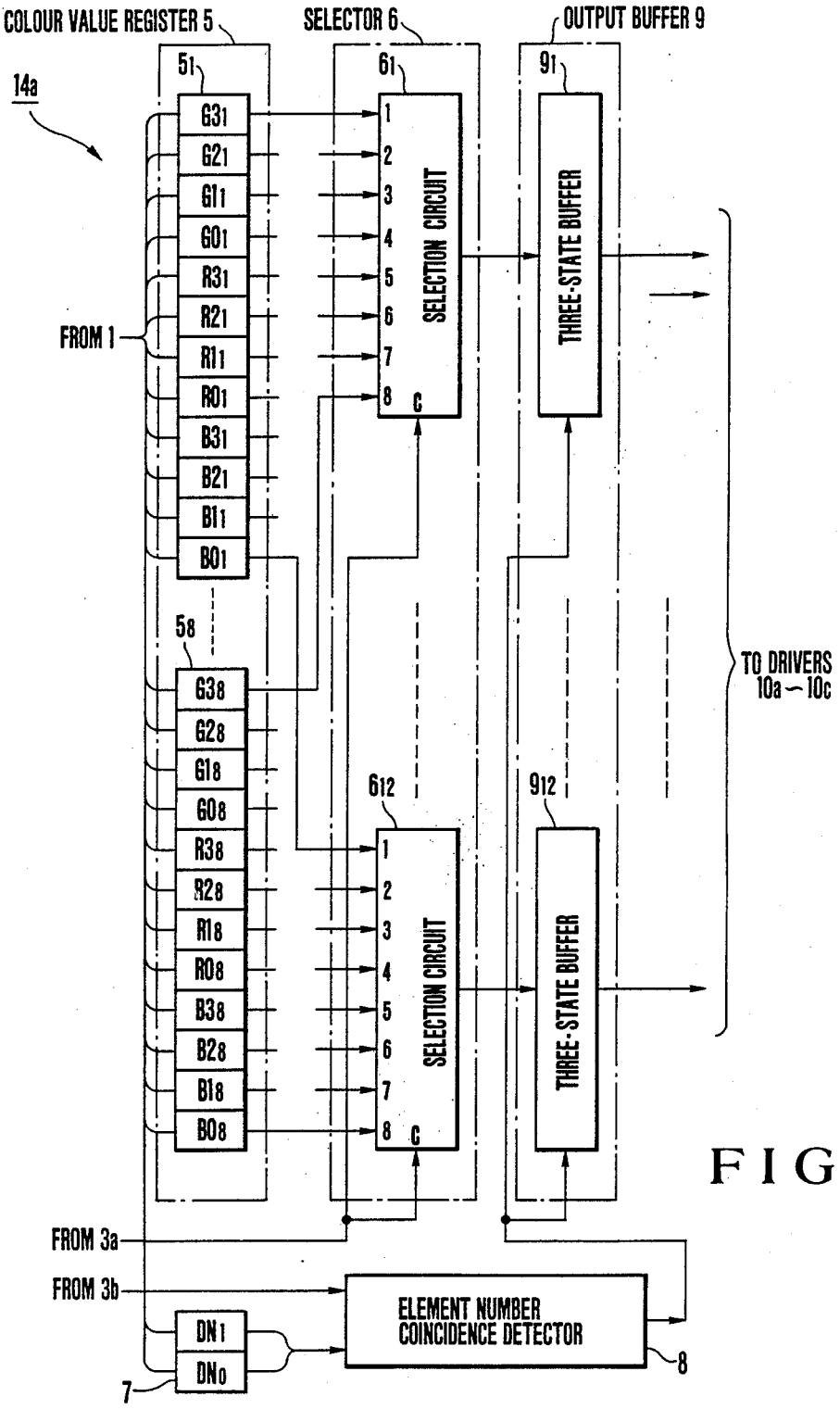
FIG. 4 is a block diagram of a color designation circuit in the color control circuit shown in FIG. 3.

FIG. 4 is a detailed circuit diagram of the color designation circuit 14*a* in FIG. 3. Other color designation circuits 14*b* to 14*d* have the same arrangement as that of the color designation circuit 14a. The same reference numerals as in FIG. 3 denote the same parts in FIG. 4. The color value register 5 comprises eight 12-bit registers $5_1$ to $5_8$. The selector 6 comprises twelve selection circuits $6_1$ to $6_{12}$. The output buffer 9 comprises twelve three-state buffers $9_1$ to $9_{12}$. Each 5 three-state buffer $9_i$ (i=1 to 12) is connected to the output of the corresponding selection circuit $6_i$. DN1 and DN0 represent digits of the element number register 7.

The color value register 5 comprises eight 12-bit registers $5_1$ to $5_8$ connected to a processor 1 to designate colors to be displayed.

Each selection circuit $6_i$ (i=1 to 12) has an 8-bit input terminal, and the eight bits of the input terminal are connected to the ith bits of the eight 12-bit registers $5_1$ to $5_8$ in one-to-one correspondence. Terminals C of the selection circuits $6_1$ to $6_{12}$ commonly receive a 3-bit color code from the memory array 3a, and each of the selection circuits $6_1$ to $6_{12}$ selects one of the outputs of the eight color registers $5_1$ to $5_8$ in correspondence with the input 3-bit color code. The selected outputs are supplied to the corresponding three-state buffers $9_1$ to $9_{12}$. Each element number coincidence detector 8 compares the prestored element number signal stored in the 2-bit element number register 7 with a 2-bit element number signal of the display data read out from the extended video memory 3b and controls the three-state buffers $9_1$ to $9_{12}$ according to the comparison result. Therefore, any eight of the 4096 ($=2^{12}$) colors represented by the eight 12-bit color value registers $5_1$ to $5_8$ can be simultaneously displayed in the circuit arrangement (FIG. 4).

The circuit shown in FIG. 3 includes four color designation circuits 14a to 14d shown in FIG. 4, and therefore, any 32 of the 4,096 colors can be simultaneously displayed. The four color designation circuits 14a to 14d have common inputs, and their outputs are wired-OR. No additional circuits are required.

The operation of this embodiment shown in FIGS. 3 and 4 will now be described.

The 3-bit color code signal of the display data sent from the processor 1 and the 2-bit element number signal are respectively written in the memory array 3a and the extended video memory 3b under the control of the write controller 2.

The display data read out from the video memories 3a and 3b by a read controller 4 are supplied to the color designation circuits 14a to 14d. The 3-bit color code signal is supplied to the selector 6, and the 2-bit element number signal is supplied to the element number coincidence detector 8. Thirty-two 12-bit registers and four element number registers 7 store different color value signals and different element number signals, respectively.

Outputs from the eight 12-bit registers $5_1$ to $5_8$ in the color designation circuits are respectively selected by the selection circuits $6_1$ to $6_{12}$ in the color designation circuits. The selected outputs are respectively supplied to the three-state buffers $9_1$ to $9_{12}$. Of the three-state buffers $9_1$ to $9_{12}$, the buffers corresponding to coincidences between the 2-bit element number signals preset in the element number register 7 and the 2-bit element number signals of the display data read out from the extended video memory 3b are enabled in response to outputs from the corresponding element number coincidence detectors 8 to supply outputs of the selectors 6 to the drivers 10a, 10b, and 10c. Outputs from the drivers 10a, 10b, and 10c are supplied to an electron gun assembly in the CRT 11, thereby obtaining a desired image at a desired position of the CRT 11.

The present invention is exemplified by the particular embodiment described above but is not limited thereto. Various changes and modifications may be made within the spirit and scope of the invention. In the above embodiment, the element number register and the element number signal of the display data read out from the video memory are assigned with 2 bits each, and the four color designation circuits are used. However, the element number register and the element number signal of the display data read out from the video memory may be assigned with n bits each, and $2^n$ color designation circuits may be used. In this case, if the number of colors to be simultaneously displayed by one color designation circuit is given as m, any m $\times 2^n$ colors can be simultaneously displayed. In this case, a memory of (n−1) bits ×one frame and $(2^n-1)$ color designation circuits must be added to the circuit arrangement.

In the above embodiment, the element number signal can be prepared in the n-bit element number register in each color designation circuit. However, an n-bit element number signal input terminal may be provided to externally input the element number signal.

According to the present invention as described above, the element number coincidence circuit and the three-state output buffer are additionally included in each color designation circuit without using a complex means. The extended video memory for storing the element number signals of the display data and the plurality of color designation circuits are also added to the above arrangement to increase the number of colors to be simultaneously displayed on the screen. Therefore, the display control circuit according to the present invention is suitable for an IC circuit. In addition, other circuits required in the circuit arrangement of FIG. 4 can be omitted. Therefore, the mounting area can be reduced, circuit reliability can be improved, and economical advantages can also obtained.

What is claimed is:

1. A display control circuit comprising:

a video memory for storing display data assigned with a plurality of bits corresponding to each pixel of a display screen of a display device;

rewritable color value register means rewritable by a processor;

selector means operably connected with said rewritable color value register means and with said video memory for selecting outputs from said rewritable color value register means in accordance with color signal information of the display data read out from said video memory;

element number register means for storing preset element numbers;

element number coincidence detector means operably connected with said element number register means and with said video memory for comparing element number information of the display data read out from said video memory with the preset element numbers; and output buffer means operably connected with said element number coincidence detector means and with said selector means, controlled in accordance with an output from said element number coincidence detector means, for supplying a signal to a driver for said display device.

2. A display control circuit according to claim 1, wherein said rewritable color value register means, said selector means, said element number register means, said element number coincidence detector means, and said output buffer means constitute a color designation integrated circuit.

3. A display control circuit comprising:

a memory array for storing display data each assigned with a plurality of bits corresponding to each pixel of a display screen of a display device; and a plurality of color designation integrated circuits for commonly receiving color signal information of the display data read out from said memory array and display information supplied from a processor and for designating colors to be displayed on said display screen of said display device, said plurality of color designation integrated circuits operably connected with said memory array, each of said plurality of color designation integrated circuits comprising: rewritable color value register means rewritable by said processor, selector means operably connected with said rewritable color value register means and with said memory array for selecting outputs from said rewritable color value register means in accordance with color signal information of the display data read out from said memory array, element number register means for storing preset element numbers, element number coincidence detector means operably connected with said element number register means and with said memory array for comparing element number information of the display data read out from said memory array with the preset element numbers, and output buffer means operably connected with said element number coincidence detector means and with said selector means, controlled in accordance with an output from said element number coincidence detector means, for supplying a signal to a driver for said display device.

4. A display control circuit according to claim 3, wherein said rewritable color value register means comprises m n-bit registers, said selector means comprises n selectors for receiving the same bits as those of each of said n-bit registers and selecting one input in accordance with color code data from said memory array, and said output buffer means comprises n three-state buffers for supplying the outputs from said selectors to the drivers in accordance with output signals from said element number coincidence detector means.

* * * * *